US005181550A

United States Patent [19]

Blazek et al.

[11] Patent Number: 5,181,550

[45] Date of Patent: Jan. 26, 1993

[54] METHOD OF MAKING A TURBINE ENGINE COMPONENT

[75] Inventors: William S. Blazek, Valley City; Harold L. Wheaton, Bowerston, both of Ohio

[73] Assignee: PCC Airfoils, Inc., Cleveland, Ohio

[21] Appl. No.: 760,873

[22] Filed: Sep. 16, 1991

[51] Int. Cl.[5] ..... B22D 19/04

[52] U.S. Cl. ..... 164/100; 164/98

[58] Field of Search ..... 164/98, 100

[56] References Cited

U.S. PATENT DOCUMENTS 4,728,258 3/1988 Blazek et al. .

*Primary Examiner*—Kuang Y. Lin

*Attorney, Agent, or Firm*—Tarolli, Sundheim & Covell

[57] ABSTRACT

A turbine engine component is made by forming a heat resistant layer on each airfoil of a plurality of airfoils. This heat resistant layer has a higher melting temperature than the melting temperature of material forming the airfoil. After heat resistant layers have been formed on the airfoils, a mold is formed around the airfoils. Molten metal is poured into the mold. The molten metal engages the heat resistant layers on the airfoils and solidifies to form a shroud ring. As the molten metal solidifies, slip joints between the solidified metal and end portions of the airfoils are free of bonds. The heat resistant layer is at least partially formed of chromium sesquioxide ($Cr_2O_3$). A layer of chromium sesquioxide is formed by heating a nickel-chrome superalloy airfoil. As the airfoil is heated, the layer of metal immediately adjacent to the outer surface of the airfoil is depleted of chromium. This results in the formation of an outer layer of chromium sesquioxide and an inner layer from which the chromium has been depleted. Both layers have a higher melting temperature than the melting temperature of the material forming the airfoil.

14 Claims, 3 Drawing Sheets

METHOD OF MAKING A TURBINE ENGINE COMPONENT

BACKGROUND OF THE INVENTION

The present invention relates to an improved method of making a turbine engine component with slip joints which interconnect a shroud ring and a plurality of airfoils.

A known turbine engine component having slip joints which interconnect a shroud ring and a plurality of airfoils is disclosed in U.S. Pat. No. 4,728,258. This patent indicates that metallurgical bonds do no form between the ends of the airfoils and a shroud ring due to an oxide coating over the ends of the airfoils. This oxide coating over the ends of the airfoils is formed during handling of the airfoils in the atmosphere. The oxide coating is black and is believed to be a nickel, chromium, and/or aluminum oxide coating which forms as a result of exposure of the airfoil to an oxygen-containing atmosphere at relatively low temperatures. The black oxide coating has a low melting temperature relative to $Cr_2O_3$.

When castings made by the process disclosed in U.S. Pat. No. 4,728,258 were sectioned, it was found that fusion bonds occasionally occurred at the slip joints between the end portions of the airfoils and the shroud ring. Although there were many instances when the bonding did not occur, the possibility of having a fusion bond at the slip joint reduces the degree of confidence which can be placed in the process of making the turbine engine component. Unfortunately, the presence of a bond between the end portions of the airfoils and the shroud ring cannot be easily detected without destroying the turbine engine component. Turbine engine components having slip joints between airfoils and shroud rings are also disclosed in U.S. Pat. Nos. 4,955,423 and 4,961,459.

SUMMARY OF THE INVENTION

The present invention relates to a new and improved method of making a turbine engine component with joints between airfoils and a shroud ring free of bonds to enable thermal expansion to occur between the airfoils and the shroud ring. This is accomplished by forming heat resistant layers around the airfoils. Each of the heat resistant layers has a melting temperature which is greater than the melting temperature of the material forming the airfoil around which the layer extends.

When molten metal is poured into a mold and flows into a shroud ring mold cavity, the molten metal engages the heat resistant layers. At this time, the molten metal is at a temperature which is below the melting temperature of the heat resistant layers. Therefore, fusion bonds do not form between the heat resistant layers and the molten metal as the metal solidifies.

Although the heat resistant layers could be formed in many different ways on airfoils having many different compositions, it is preferred to form the heat resistant layers on nickel-chrome superalloy airfoils. This is done by heating a portion of the airfoil which is to be exposed to molten metal. Thus, the portion of the nickel-chrome superalloy airfoil which is engaged by the molten shroud ring metal is heated to a temperature above 1,093° C. in an atmosphere containing oxygen (air). This results in the formation of a chromium sesquioxide ($Cr_2O_3$) layer having a characteristic green oxide color, around the end portion of the airfoil.

Simultaneously with the forming of the green chromium sesquioxide layer on the outside of the airfoil, a heat resistant inner layer is formed. This inner layer results from a depletion of chromium and other elements, from the nickel-chrome superalloy metal forming the airfoil. Although the inner layer has a lower melting temperature than the green chromium sesquioxide outer layer, the inner layer has a higher melting temperature than the nickel-chromium superalloy metal forming the airfoil. The inner and outer layers cooperate to form the heat resistant layer. However, the heat resistant layer could be formed by only one of the inner and outer layers if desired.

Accordingly, it is an object of this invention to provide a new and improved method of making a turbine engine component having a shroud ring with a plurality of airfoils disposed in an annular array and wherein a heat resistant layer extends at least partially around one end portion of each of the airfoils and has a melting temperature which is greater than the melting temperature of the material forming the airfoils.

Another object of this invention is to provide a new and improved method of making a turbine engine component as set forth in the preceding object and wherein the heat resistant layer is at least partially formed of chromium sesquioxide ($Cr_2O_3$).

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
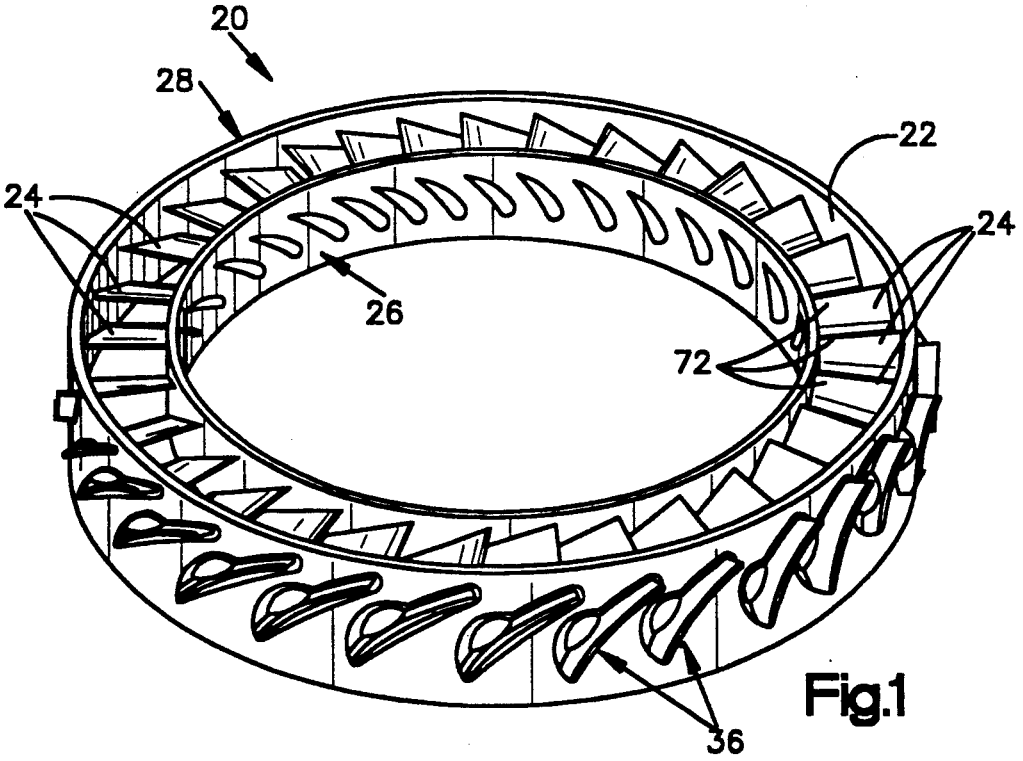
FIG. 1 is a pictorial illustration of a turbine engine component constructed in accordance with a method of the present invention.

A turbine engine component 20 constructed in accordance with the present invention is illustrated in FIG. 1. In the present instance, the turbine engine component 20 is a stator which will be fixedly mounted between the combustion chamber and first stage rotor of a turbine engine. The hot gases from the combustion chamber are directed against an annular array 22 of airfoils or vanes 24 which extend between a circular inner shroud ring 26 and a circular outer shroud ring 28. Although it is believed that the turbine engine component 20 constructed in accordance with the present invention will be particularly advantageous when used between the combustion chamber and first stage rotor of a turbine engine, it should be understood that turbine engine components constructed in accordance with the present invention can be used at other locations in an engine.

The airfoils 24 are formed separately from the inner and outer shroud rings 26 and 28. This allows the airfoils 24 to be formed of metal and/or ceramic materials which can withstand the extremely high operating temperatures to which they are exposed in the turbine engine. Since the shroud rings 26 and 28 are subjected to operating conditions which differ somewhat from the operating conditions to which the airfoils 24 are subjected, the shroud rings 26 and 28 can advantageously be made of materials which are different from the materials of the airfoils.

The airfoils 24 (FIGS. 1-3) are formed separately from the shroud rings 26 and 28. In the present instance, the airfoils 24 are cast as a single crystal of nickel-chrome superalloy metal. The airfoils 24 may be cast by a method generally similar to that disclosed in U.S. Pat. No. 3,494,709. However, it should be understood that the airfoils 24 could be formed with a different crystallographic structure and/or of a different material if desired. For example, it is contemplated that the airfoils 24 could have a columnar grained crystallographic structure or could be formed of a ceramic or metal and ceramic material if desired.

Figure 4:
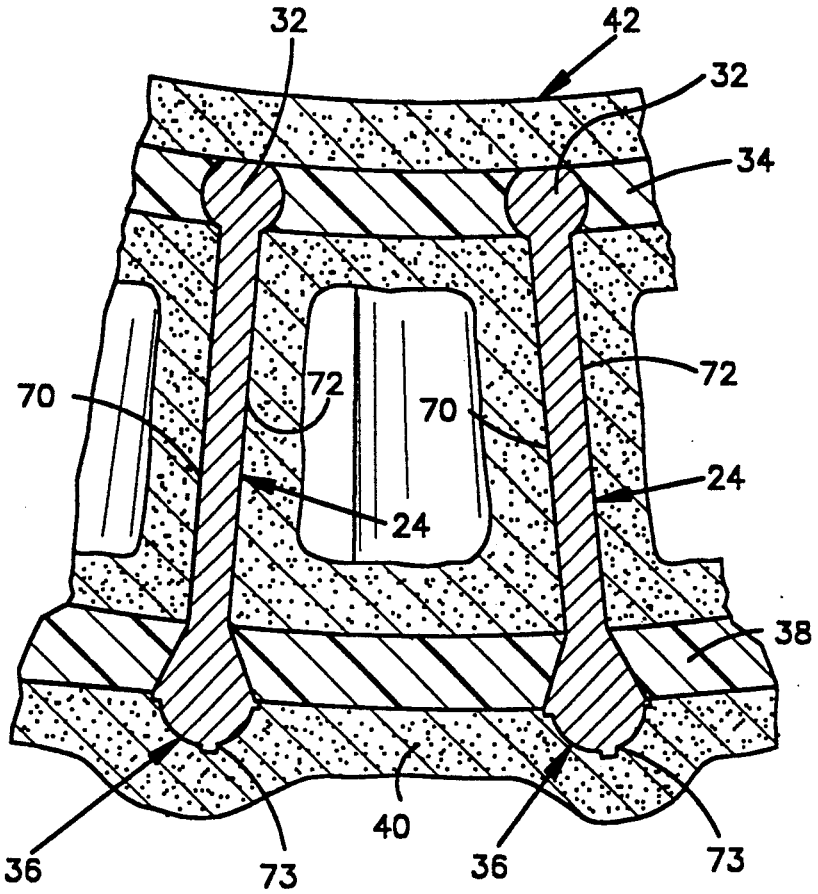
FIG. 4 is a fragmentary sectional view illustrating the manner in which ceramic mold material covers the airfoils and shroud ring patterns during the forming of a mold for the turbine engine component of FIG. 1.

To fabricate the turbine engine component 20, an inner end portion 32 of the metal airfoil 24 is embedded in a wax inner shroud ring pattern 34 (see FIG. 4). Similarly, an outer end portion 36 of each of the metal airfoils 24 is embedded in a wax outer shroud ring pattern 38. The airfoils 24 and wax inner and outer shroud ring patterns 34 and 38 are covered with ceramic mold material 40 to form a mold 42.

Figure 5:
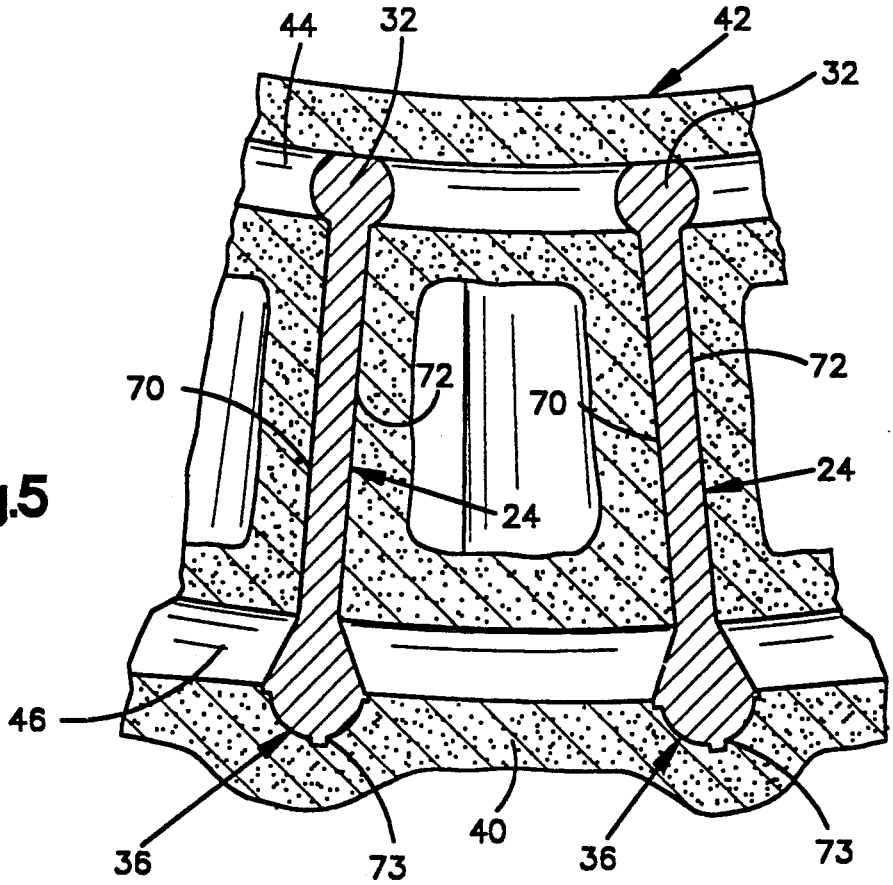
FIG. 5 is a fragmentary sectional view illustrating the relationship between the metal airfoils and shroud ring mold cavities formed by removing the shroud ring patterns of FIG. 4.

The wax material of the shroud ring patterns 34 and 38 is then removed from the mold 42 to leave a pair of circular shroud ring mold cavities 44 and 46 (FIG. 5). The shroud ring mold cavities 44 and 46 extend completely around the inner and outer end portions 32 and 36 of the airfoils 24. However, end surfaces on the outer end portions 36 of the airfoils 24 are covered by the ceramic mold material 40.

Figure 6:
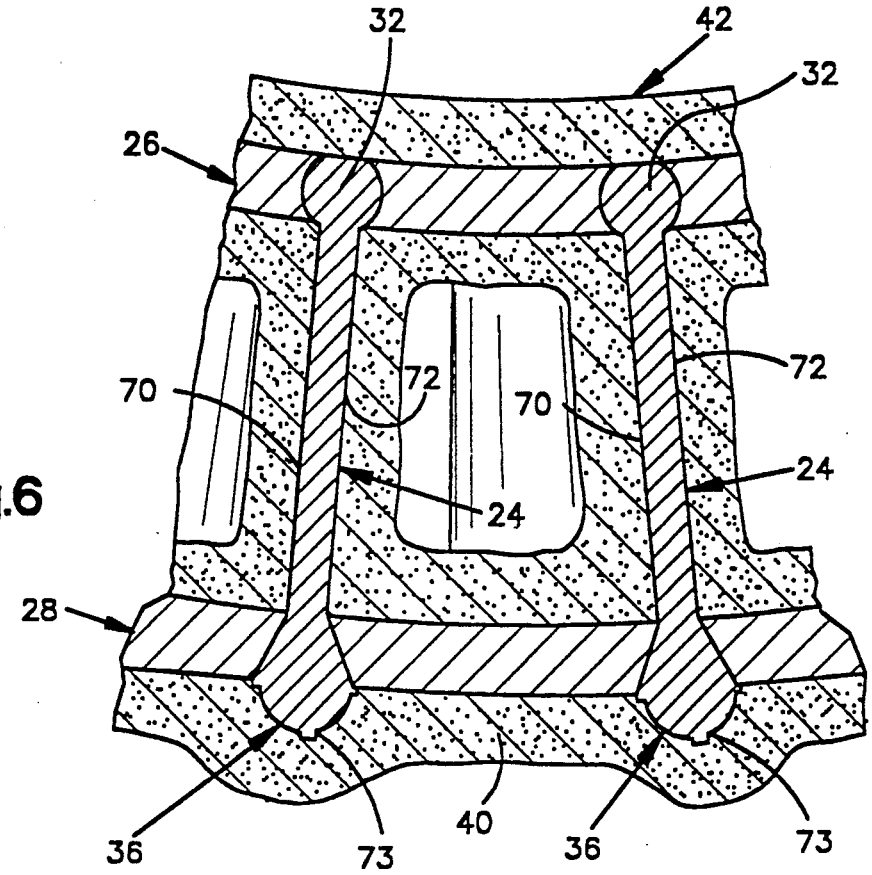
FIG. 6 is a fragmentary sectional plan view illustrating the relationship between the airfoils and inner and outer shroud rings cast in the shroud ring mold cavities of FIG. 5.

The shroud ring mold cavities 44 and 46 are then filled with molten metal (FIG. 6). The molten metal solidifies to form inner and outer shroud rings 26 and 28. As the molten metal solidifies, the airfoils 24 act as chills to promote solidification of the molten metal of the shroud rings in a direction which is transverse to the leading and trailing edges of the airfoils 24.

In accordance with a feature of the present invention, joints between the airfoils 24 and shroud ring 28 are free of metallurgical bonds. Thus, a heat resistant layer 48 (FIG. 8) is formed on the outer end portion 36 of each of the airfoils 24. The heat resistant layers 48 have a melting temperature which is greater than the melting temperature of the material forming the airfoils 24. The heat resistant layer 48 for an airfoil 24 formed of a nickel-chrome superalloy includes an outer layer 49 which is preferably formed of chromium sesquioxide ($Cr_2O_3$) and completely encloses the outer end portion 36 of the airfoil 24. Although it is presently preferred to form the airfoil 24 of a nickel-chrome superalloy and to form the heat resistant outer layer 49 of chromium sesquioxide, it is contemplated that the airfoil and/or heat resistant layer could be formed of different materials if desired.

Figure 8:
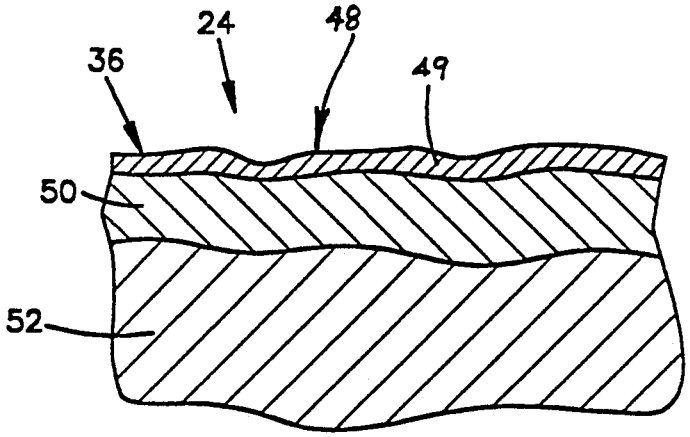
FIG. 8 is an enlarged fragmentary sectional view of part of the outer end portion of the airfoil of FIG. 7 and illustrating the relationship between heat resistant inner and outer layers formed during heating of the airfoil in an atmosphere containing oxygen.

In accordance with another feature of the present invention, the metal alloy forming the airfoil 24 is depleted of one or more elements adjacent to the surface of the outer end portion 36 to form an inner heat resistant layer 50 (FIG. 8). When an element is depleted from a main body 52 of a metal alloy to form the inner heat resistant layer 50, the melting temperature of the inner heat resistant layer will be greater than the melting temperature of the main body 52 of the metal alloy.

The inner heat resistant layer 50 for an airfoil 24 formed of a nickel-chrome superalloy is formed of nickel enriched phase from which the chromium and, to a lesser extent, other elements have been at least partially removed. Of course, if the airfoil 24 was formed of an alloy other than a nickel-chrome superalloy, the inner layer 50 could be formed of a metal other than nickel from which a metal other than chromium has been at least partially removed. The outer layer 49 and inner layer 50 cooperate to form the heat resistant layer 48. However, the heat resistant layer 48 could be formed by just the outer layer 49 or just the inner layer 50 if desired.

In the preferred embodiment of the invention, the outer end portion 36 of the airfoil 24 is enclosed by two heat resistant layers 49 and 50. The outer heat resistant layer 49 has a higher melting temperature than the inner heat resistant layer 50. However, the inner heat resistant layer 50 has a higher melting temperature than the main body 52 of the metal alloy.

In one specific preferred embodiment of the invention, the main body 52 of the airfoil 24 was formed of a nickel-chrome superalloy having a melting temperature below 1,500° C. The outer layer 49 was formed of chromium sesquioxide ($Cr_2O_3$) having a melting temperature above 2,000° C. The inner layer 50 contained less chromium than the main body 52 of the airfoil and had a melting temperature which was above the melting temperature of the main body and somewhat below the melting temperature of pure nickel.

Thus, in the specific preferred embodiment of the invention described in the preceding paragraph, the main body 52 of the airfoil 24 had a melting temperature of approximately 1,315° C. The outer layer 49 had a melting temperature of between 2,279° C. and 2,435° C. The inner layer 50 had a melting temperature approaching the melting temperature of pure nickel or about 1,400° C.

The heat resistant layers 49 and 50 prevent the formation of metallurgical bonds between the airfoils 24 and the shroud ring 28. Thus, there is only a mechanical interconnection between the outer end portions 36 of the airfoils 24 and the shroud ring 28. If the outer end portions 36 of the airfoils 24 were covered with a black oxide outer layer which may be formed of nickel, chromium, and/or aluminum, the outer layer would have a relatively low melting point compared to $Cr_2O_3$ and metallurgical bonds between the shroud ring 28 and outer end portions of the airfoils can occasionally occur. This may result from the black oxide outer layer having a lower melting point than the nickel chrome superalloy forming the airfoil. However, if the outer end portions 36 of the airfoils 24 are covered with a heat resistant layer 49 of chromium sesquioxide ($Cr_2O_3$) having a characteristic green color, the melting point of the layer is so high that fusion bonds do not occur between the outer end portions of the airfoils and the outer shroud ring 28.

Since the shroud rings 26 and 28 (FIG. 1) are cast separately from the airfoils 24, the shroud rings can be formed of a metal which is different than the metal of the airfoils. Thus, in the specific instance described herein, the airfoils 24 were cast as single crystals of a nickel-chrome superalloy (CMSX-3) while the inner and outer shroud rings 26 and 28 were formed of a cobalt chrome superalloy, such as MAR M509. Although the inner and outer shroud rings 26 and 28 were cast of the same metal, it is contemplated that the inner shroud ring 26 could be cast of one metal and the outer shroud ring 28 cast of another metal. The airfoils 24 are preferably formed of a third metal or ceramic material in order to optimize the operating characteristics of the turbine engine component 20. The heat resistant layer 48 may be formed of one or more layers of material having a melting temperature above the melting temperature of the main body 52 of material forming the airfoils 24.

During operation of a turbine engine, the airfoils 24 will be heated to higher temperature than the inner and outer shroud rings 26 and 28. Due to the fact that the airfoils 24 are heated to a higher temperature than the shroud rings 26 and 28, there will be greater thermal expansion of the airfoils 24 than the shroud rings. Slip joints 58 (see FIG. 2) are provided between the outer shroud ring 28 and the outer end portion 36 of each of the airfoils 24 to accommodate thermal expansion of the airfoils. Although the slip joints 58 have been shown as being between the outer shroud ring 28 and the airfoils 24, the slip joints 58 could be between the inner shroud ring 26 and airfoils if desired. Although the outer end portions 36 of the airfoils 24 have been shown in FIGS. 1–3 as being exposed, they could be completely or partially enclosed if desired, in a manner similar to the disclosures in U.S. Pat. Nos. 4,955,423 and 4,961,459.

The inner end portion 32 of each of the airfoils 24 is anchored in and held against axial movement relative to the inner shroud ring 26. Therefore, upon heating of the airfoils 24 to a temperature which is above the temperature of the shroud rings 26 and 28, each airfoil 24 expands radially outwardly and opens a slip joint 58 (FIG. 3) between the outer end portion 36 of the airfoil and the outer shroud ring 28. By opening the slip joints 58 in the manner illustrated in FIG. 3, the application of thermal stresses to the airfoils 24 is avoided. Since there are no metallurgical bonds between the airfoils 24 and the outer shroud ring 28, the slip joints 58 are readily opened with the application of a minimum of stress to the airfoils. Although the slip joins 58 are between the outer end portions 36 of the airfoils 24 and the outer shroud ring 28, the slip joints could be between the inner end portions 32 of the airfoils 24 and the inner shroud ring 26, in a manner similar to that disclosed in U.S. Pat. No. 4,961,459.

Airfoil

Each of the identical airfoils 24 (FIG. 2) has a relatively wide inner end portion 32. The outwardly projecting inner end portion 32 provides for a mechanical interconnection between the airfoil 24 and the inner shroud ring 26 throughout a substantial arcuate distance along the shroud ring 26. In addition, the inner end portion 32 of the airfoil has a bulbous configuration to provide for a mechanical interlocking between the inner shroud ring 26 and the inner end portion 32 of the airfoil 24. Due to the mechanical connection between the inner end portion 32 of the airfoil 24 and the inner shroud ring 26, the inner end portion 32 of each airfoil 24 is anchored and cannot move radially outwardly of the inner shroud ring.

Figure 2:
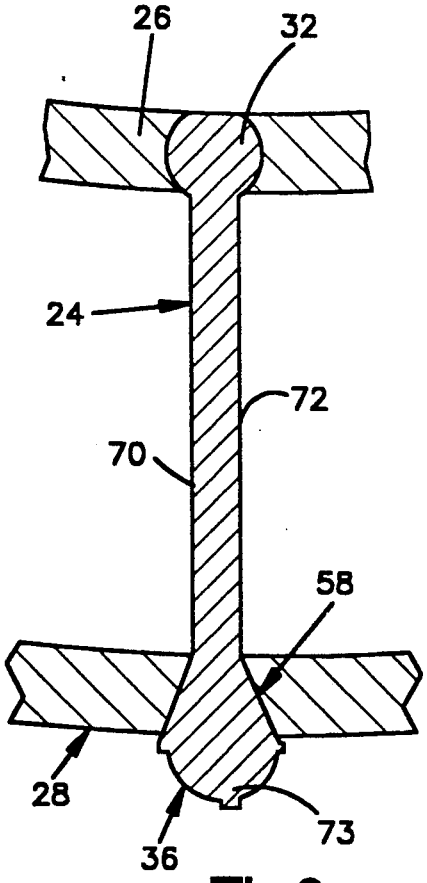
FIG. 2 is a schematic sectional view illustrating the relationship between an airfoil and inner and outer shroud rings of the turbine engine component of FIG. 1 when the airfoil and shroud rings are at the same temperature.
Figure 3:
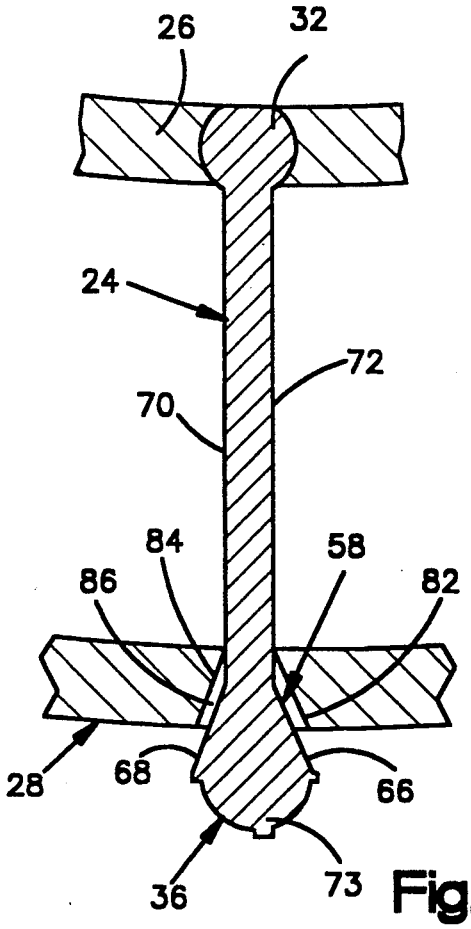
FIG. 3 is a fragmentary sectional view, generally similar to FIG. 2, illustrating the manner in which thermal expansion of the airfoil opens a slip joint between the airfoil and the outer shroud ring.

The outer end portion 36 of the airfoil 24 is tapered inwardly from the outer shroud ring 28 toward the inner shroud ring 26 (see FIGS. 2 and 3). Thus, the outer end portion 36 of the airfoil 24 has a pair of sloping side surface areas 66 and 68 (FIG. 3) which slope radially inwardly to a concave major side surface 70 and a convex major side surface 72. In addition, the outer edge portion 36 of the airfoil 24 has an end section 73. The end section 73 and side surfaces 70 and 72 engage the ceramic mold material 40 (FIGS. 4 and 5) to firmly anchor the airfoil 24 in place in the mold 42.

In accordance with a feature of the present invention, the outer end portion 36 of the airfoil 24 has an outer heat resistant layer 49 (FIG. 8) and an inner heat resistant layer 50. The heat resistant layers 49 and 50 cooperate to form the heat resistant layer 48. The heat resistant layer 48 completely encloses the outer end portion 36 of the airfoil 24 and prevents the formation of bonds between the outer end portion of the airfoil and the outer shroud ring 28. The lack of bonds between the outer end portion 36 of the airfoil 24 and the outer shroud ring 28 enables relative movement to occur between the airfoil 24 and the outer shroud ring during use of the turbine engine component 20. Although it is preferred to use the two heat resistant layers 49 and 50 together, only a single heat resistant layer 49 or 50 could be used if desired.

Figure 7:
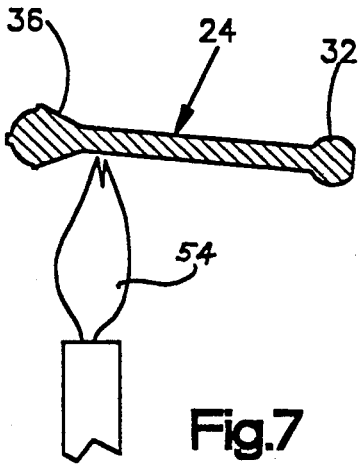
FIG. 7 is a schematic illustration depicting the manner in which an outer end portion of an airfoil is heated to form a heat resistant layer on the outer end portion of the airfoil.

The heat resistant layers 49 and 50 (FIG. 8) are simultaneously formed by heating the nickel-chrome superalloy (CMSX-3) forming the airfoil 24. The airfoil 24 is heated by a flame 54 (FIG. 7), in an oxygen containing atmosphere (air), to a temperature sufficient to cause a layer 49 of chromium sesquioxide ($Cr_2O_3$) to form around the outer end portion 36 of the airfoil 24. The layer 49 has the characteristic green color of chromium sesquioxide. By experimentation it has been determined that the outer end portion 36 of the airfoil 24 has to be heated in air to a temperature above 1,093° C. to form the layer 49 of chromium sesquioxide. The heat resistant layer 49 of chromium sesquioxide ($Cr_2O_3$) is preferably formed by flame or electric heating the outer end portion 36 of the airfoil 24 to a temperature of approximately 1,149° C. in air for approximately 45 minutes.

Experiments were conducted to determine the temperature to which the outer end portion 36 of an airfoil 24 had to be heated in air to form chromium sesquioxide ($Cr_2O_3$). Thus, three airfoils 24 formed of a nickel-chrome superalloy (CMSX-3), were heated in air to different temperatures for 45 minutes. The results were as follows:

| Airfoil | Heated to | Result |
|---|---|---|
| 1. | 1,038° C. | black oxide |
| 2. | 1,093° C. | black and green oxide |
| 3. | 1,149° C. | green oxide ($Cr_2O_3$) |

Thus, it was only by heating the nickel-chrome superalloy airfoils to a temperature above 1,093° C. that a layer 48 of chromium sesquioxide ($Cr_2O_3$) having a characteristic green color was obtained. A black layer, which is believed to be of nickel, chromium, and/or aluminum oxide, or a black and green layer of both the oxide and chromium sesquioxide were obtained when the outer end portions 36 of the airfoils were heated to temperatures of 1,038° C. and 1,093° C.

By inspecting turbine engine components 20, it has been determined that bonds can occur between the outer end portions 36 of the airfoils 24 and the shroud ring 28 when a black or black and green layer of oxide is present. However, there were no bonds between the outer end portions 36 of the airfoils 24 and the shroud ring 28 when only a green layer of chromium sesquioxide was present.

The inner layer 50 is formed by depleting the chromium from a layer of the nickel-chrome superalloy (CMSX-3) forming the airfoil 24. Thus, when the end portion 36 of the airfoil 24 is heated in air to a temperature above 1,093° C. to form the chromium sesquioxide ($Cr_2O_3$) outer layer 49, the chromium in a layer 50 of metal immediately beneath the surface of the airfoil 24 moves to the surface of the airfoil. Although a continuous outer layer 49 of chromium sesquioxide ($Cr_2O_3$) is formed on the surface of the outer end portion of the airfoil 24, elements other than chromium are depleted from the layer 50 of metal immediately beneath the surface of the airfoil. Thus, aluminum and other elements are also depleted from the layer 50.

Although it is preferred to simultaneously form the heat resistant layers 49 and 50 by heating the nickel-chrome superalloy airfoils in an oxygen containing atmosphere, the heat resistant layers could be formed in a different manner if desired. Thus, the heat resistant layer 48 could be formed by other methods, such as vapor deposition, spraying or dipping. Of course, the heat resistant layer 48 applied by these methods could have a composition other than chromium sesquioxide. It is believed that the formation of the heat resistant layer 48 by methods other than heating the airfoils may be particularly advantageous when the airfoils 24 are formed of a material other than a nickel-chrome superalloy. However, it is presently preferred and believed to be advantageous, to form the airfoils 24 of a nickel-chrome superalloy and to form the heat resistant layer 48 by heating the airfoils in an oxygen containing atmosphere.

Shroud Ring Pattern Segments

The wax shroud ring patterns 34 and 38 (FIG. 4) are formed by interconnecting inner and outer shroud ring pattern segments. To mount the wax pattern segments on the inner and outer end portions 32 and 36 of the airfoils 24, the airfoil is positioned with its inner and outer end portions 32 and 36 extending into die cavities. The die cavities have a configuration corresponding to the configuration of the pattern segments. Hot wax is then injected into the die cavities. The hot wax solidifies to form the pattern segments.

The hot wax which is used to form the pattern segments can be either a natural wax or an artificial substance having characteristics which are generally similar to natural waxes. Thus, the wax used to form the pattern segments could be a polymeric material such as polystyrene.

The inner wax pattern segment extends completely around the inner end portion 32 of the airfoil 24 and almost completely encloses the inner end of the airfoil (FIG. 4). The outer wax pattern segment extends completely around the outer end portion 36 of the airfoil 24 and engages only the heat resistant layer 48. However, the outer end 73 of the airfoil 24 is exposed. Since the side surfaces 66 and 68 (FIG. 3) on the outer end portion 36 of the airfoil 24 taper inwardly, the exposed outer end 73 of the airfoil 24 has a greater cross sectional area in a plane perpendicular to a central axis of the airfoil than any other cross section of the outer end portion of the airfoil.

A pattern assembly is fabricated. The pattern assembly includes the wax inner shroud ring pattern 34, the wax outer shroud ring pattern 38, and a wax gating pattern. The wax gating pattern, like the shroud ring patterns 34 and 38, can be formed of either a natural wax or an artificial substance having characteristics which are generally similar to natural waxes.

In the illustrated turbine engine component 20, there are thirty-one airfoils 24 in the circular array 22 (FIG. 1) of airfoils. In this instance, each of the wax pattern segments has an arcuate extent corresponding to approximately 11.6 degrees of a shroud ring pattern 34 or 36. Of course, the arcuate extent of the wax pattern segments will depend upon the specific number of airfoils 24 provided in the annular array 22 of airfoils.

Molding Shroud Rings

In order to form a mold 42, the entire pattern assembly is completely covered with liquid ceramic mold material. The ceramic mold material 40 (FIG. 4) completely covers the exposed surfaces of the metal airfoils 24, wax inner shroud ring 34, wax outer shroud ring 38 and wax gating pattern. The entire pattern assembly may be covered with the liquid ceramic mold material by repetitively dipping the pattern assembly in a slurry of liquid ceramic mold material.

Although many different types of slurries of ceramic mold material could be utilized, one illustrative slurry contains fused silica, zircon, and other refractory materials in combination with binders. Chemical binders such as ethylsilicate, sodium silicate and colloidal silica can be utilized. In addition, the slurry may contain suitable film formers, such as alginates, to control viscosity and wetting agents to control flow characteristics and pattern wettability.

In accordance with common practices, the initial slurry coating applied to the pattern assembly 88 may contain a finely divided refractory material to produce an accurate surface finish. A typical slurry for a first coat may contain approximately 29% colloidal silica suspension in the form of a 20% to 30% concentrate. Fused silica of a particle size of 325 mesh or smaller in an amount of 71% can be employed together with less than 1%–10% by weight of a wetting agent. Generally, the specific gravity of the ceramic mold material may be on the order of 1.75 to 1.80 and have a viscosity of 40 to 60 seconds when measured with a Number 5 Zahn cup at 75° to 85° F. After the application of the initial coating, the surface is stuccoed with refractory materials having particle sizes on the order of 60 to 200 mesh. Although one known specific type of ceramic mold material has been described, other known types of mold materials could be used if desired.

The ceramic mold material 40 (FIG. 4) overlies and is in direct engagement with the major side surfaces 70 and 72 of the metal airfoils 24. In addition, the mold material overlies the exposed end 73 of the airfoils 24 (see FIGS. 8 and 9). Due to the inwardly tapered configuration of the end portions 36 of the airfoils 24, the ceramic mold material overlies the end portions where their cross sectional areas are a maximum.

Although the ends 73 of the airfoils have been shown as protruding outwardly, it is contemplated that the ends 73 of the airfoils could extend generally parallel to the side surface of the outer shroud ring pattern 38 if desired. Where weight savings is important, it is believed that the end portion 73 of the airfoils will be trimmed to eliminate any excess metal.

After the ceramic mold material 40 has at least partially dried, the mold 42 is heated to melt the wax material of the inner and outer shroud ring patterns 34 and 38 and the wax gating pattern. The melted wax is poured out of the mold 42 through an open end of a combination pour cup and downpole. This results in inner and outer shroud ring mold cavities 44 and 46 (FIG. 5) being connected with a combination downpole and pour cup having a configuration corresponding to the downpole and pour cup pattern by passages corresponding to the configuration of the wax gating patterns.

The mold 42 is then fired at a temperature of approximately 1,038° C. for a time sufficient to cure the mold sections. This results in the airfoils 24 being securely fixed in place relative to the inner and outer shroud ring mold cavities 44 and 46 by the rigid ceramic mold material 40. During handling of the airfoils 24 and firing of the mold 42, a black oxide layer, which is believed to be a nickel, chromium, and/or aluminum oxide is formed on the outside surface of the blades 24 in locations where the heat resistant layer 49 of chromium sesquioxide ($Cr_2O_3$) is not formed. The heat resistant layer 48 remains unchanged during firing of the mold 42.

Once the mold 42 has been formed, molten metal (CMSX-3) is poured into the mold through the pour cup and downpole. The molten metal flows through gating passages to the upper and lower end portions of the shroud ring mold cavities 44 and 46.

The molten metal in the annular outer shroud ring mold cavity 46 engages only the heat resistant layer 48 on the outer end portion 36 of each of the airfoils 24. The temperature of the molten metal is well below the 2,279° C. to 2,435° C. temperature at which the heat resistant chromium sesquioxide layer 49 melts. The temperature of the molten metal is probably close to but below the 1,400° C. temperature at which the heat resistant layer 50 melts.

The heat resistant chromium sesquioxide layer 49 functions as a heat resistant skin to contain any molten metal in the outer end portion 32 of the airfoil 24. Thus, the molten metal which flows into the shroud ring mold cavity will be at a temperature which is above the 1,315° C. temperature at which the nickel-chrome superalloy (CMSX-3) forming the airfoil 24 melts. However, the heat resistant inner layer 50 melts at a higher temperature, approximately 1,400° C., and functions to contain any molten metal in the main body 52 of metal alloy. The heat resistant outer layer 49 melts at a still higher temperature, approximately 2,279° C. to 2,435° C., and functions to contain any incipient melting of the inner heat resistant layer 50. Thus, the two heat resistant layers 49 and 50 cooperate to prevent exposure of any molten or almost molten metal in the outer end portion 36 of the airfoil 24 to the molten metal conducted into the outer shroud ring mold cavity. Therefore, fusion bonding does not occur between the outer end portion 36 of the airfoil 24 and the outer shroud ring 28.

While the molten metal is flowing into the shroud ring mold cavities 44 and 46, the airfoils are held against movement relative to each other and to the mold cavities by the ceramic mold material 40 engaging the major side surfaces 70 and 72 of the airfoils. The molten metal does not engage the ends 73 of the airfoils 24 since these ends are covered by the ceramic mold material 40. However, the molten metal in the inner and outer shroud ring mold cavities 44 and 46 goes completely around each of the airfoils 24 so that the end portions 32 and 36 of the airfoils are circumscribed by the molten metal. Even though the molten metal does not engage the ends 73 of the airfoils 24, the entire outer end portion 36 of each of the airfoils is enclosed by the heat resistant layer 48.

Once the molten metal has been poured, the airfoils 24 act as a chill. Therefore, the molten metal solidifies in a direction extending transverse to the central axes of the airfoils 24. However, shrinkage defects are not formed in the axially upper and lower end portions of the inner and outer shroud ring mold cavities 44 and 46. This is because the gating passages are effective to maintain a supply of molten metal to the upper and lower end portions of the shroud ring mold cavities 44 and 46 as the molten metal in the shroud ring mold cavities solidifies.

The molten metal which solidifies to form the inner and outer shroud rings 26 and 28 has a different composition than the composition of the airfoils 24. Thus, the airfoils 24 are formed of a nickel-chrome alloy, specifically CMSX-3. The inner and outer shroud rings 26 and 28 are formed of cobalt chrome superalloy, such as MAR M509. Although the shroud rings 26 and 28 are formed of the same metal, they could be formed of different metals if desired. If the shroud rings 26 and 28 are to be formed of different metals, two separate gating systems would have to be provided, that is, one gating system for the inner shroud ring mold cavity 44 and a second gating system for the outer shroud ring mold cavity 46. Of course, each gating system would have its own downpole and pour cup.

In one specific embodiment of the invention, the airfoils 24 were formed of CMSX-3 which is commercially available from Cannon-Muskegon Corporation of Muskegon, Mich. The nominal composition of CMSX-3 is:

| | |
|---|---|
| CR | 7.8% |
| Mo | 0.5% |
| Ti | 1.0% |
| Al | 5.6% |
| Co | 4.6% |
| W | 8.0% |
| Ta | 6.0% |
| Hf | 0.1% |
| C | 100 ppm max. |
| Balance | Nickel |

Of course, other nickel-chrome superalloys could be used if desired. In fact, other metals or ceramic materials could be used to form the airfoils 24 if desired. If a different metal than a nickel-chrome superalloy is used or if a ceramic material is used, the outer layer 49 may have a composition other than chromium sesquioxide. However, it is presently preferred to form the airfoils 24 of a nickel-chrome superalloy and to have the outer layer 49 formed of chromium sesquioxide ($Cr_2O_3$).

Accommodating Thermal Expansion

During use of the stator 20 (FIG. 1), the airfoils 24 are exposed to gas which comes directly from the combustion chamber. The airfoils 24 become hotter than the inner and outer shroud rings 26 and 28. Therefore, the airfoils tend to expand axially outwardly, that is in a radial direction relative to the shroud rings 26 and 28. In the absence of the slip joints 58 between each of the airfoils and the outer shroud ring 28, substantial thermal stresses would be set up in the airfoils and the inner and outer shroud rings.

When the inner and outer shroud rings 26 and 28 and airfoils 24 are at the same temperature, the slip joints 58 are tightly closed, in the manner illustrated schematically in FIG. 2. However, when the airfoils 24 are heated to a temperature which is above the temperature of the inner and outer shroud rings 26 and 28, the airfoils expand radially outwardly relative to the shroud rings. As this occurs, the slip joints 58 open, as shown schematically in FIG. 3. As the slip joints 58 open, the tapering side surfaces 66 and 68 on the outer end portions 36 of the airfoils 24 move away from similarly tapering inner side surfaces 82 and 84 on the inside openings 86 in the outer shroud ring 28.

The slip joints 58 can readily move from the closed condition of FIG. 2 to the open condition of FIG. 3 under the influence of thermal expansion forces since there is no metallurgical bond between the outer shroud ring 28 and the end portion 36 of the airfoil 24. This is due to the heat resistant layers 49 and 50 which cover the end portions 36 of the airfoils before molten metal is poured into the shroud ring mold cavity. It should be noted that the inner end portion 32 of each airfoil 24 is mechanically anchored in the inner shroud ring 26. This prevents the airfoils 24 from moving out of engagement with the inner shroud ring 26 as the slip joints 58 open.

Although the slip joints 58 have been shown herein as being between the end portion 36 of the airfoil and the outer shroud ring 28, it is contemplated that the slip joint could be provided between the inner end portion 32 of the airfoil 24 and the inner shroud ring 26. If this was done, the outer end portion 36 of the airfoil would be mechanically anchored in the outer shroud ring 28 and the heat resistent layer 48 would be formed on the inner end portion 32 of the airfoil. It is also contemplated that in certain types of turbine engine components it may be desirable to have slip joints formed between the airfoil 24 and both the inner and outer shroud rings 26 and 28. If this was done, the inner end portion 32 of the airfoil 24 would be tapered radially outwardly so that the end portion 32 of the airfoil could move inwardly from the inner shroud ring 26 in much the same manner as in which the outer end portion 36 of the airfoil 24 moves outwardly of the outer shroud ring 28. Of course, heat resistant layers 48 would then be provided on both the inner and outer end portions 32 and 36 of the airfoils.

In the illustrated embodiment of the invention, the inner and outer shroud rings 26 and 28 are positioned in a concentric relationship with the airfoils 24 disposed in a radially extending annular array between the shroud sections. In certain known turbine engine components, the shroud rings have the same diameter and the airfoils extend in an axial direction between the shroud rings. Of course, these shroud rings could be cast around preformed airfoils in much the same way as in which the shroud rings 26 and 28 are cast around the airfoils 24. It is contemplated that suitable slip joints could also be provided between the airfoils and shroud rings in this type of turbine engine component.

Although one specific type of slip joint 58 has been illustrated in FIGS. 2 and 3, it is contemplated that other types of slip joints could be used. For example, the slip joins could be disposed in cavities in the inner or outer shroud rings 26 or 28 in the manner disclosed in U.S. Pat. No. 4,961,459. The shroud ring in which the slip joints are provided could have a rail, in the manner disclosed in U.S. Pat. No. 4,955,423.

Conclusion

The present invention relates to a new and improved method of making a turbine engine component 20 with joints 58 between the airfoils 24 and the shroud ring 28 free of bonds to enable thermal expansion to occur between the airfoils and the shroud ring. This is accomplished by forming heat resistant layers 48 around the airfoils. Each of the heat resistant layers 48 has a melting temperature which is greater than the melting temperature of the material forming the airfoil 24 around which the layer extends.

When molten metal is poured into the mold 40 and flows into the shroud ring mold cavity 46, the molten metal engages the heat resistant layers 48. At this time, the molten metal is at a temperature which is below the melting temperature of the heat resistant layers 48. Therefore, fusion bonds do not form between the heat resistant layers 48 and the molten metal as the metal solidifies.

Although the heat resistant layers 48 could be formed in many different ways on airfoils 24 having many different compositions, it is preferred to form the heat resistant layers on nickel-chrome superalloy airfoils. This is done by heating a portion of the airfoil 24 which is to be exposed to molten metal. Thus, the portion of the nickel-chrome superalloy airfoil 24 which is engaged by the molten shroud ring metal is heated to a temperature above 1,093° C. in an atmosphere containing oxygen (air). This results in the formation of a chromium sesquioxide ($Cr_2O_3$) layer 49 having a characteristic green oxide color, around the end portion of the airfoil.

Simultaneously with the forming of the green chromium sesquioxide layer 49 on the outside of the airfoil, the heat resistant inner layer 50 is formed. The heat resistant inner layer 50 results from a depletion of chromium and other elements, from the nickel-chrome superalloy metal forming the airfoil 24. Although the inner layer 50 has a lower melting temperature than the green chromium sesquioxide outer layer 42, the inner layer 50 has a higher melting temperature than the nickel-chromium superalloy metal forming the airfoil. The inner and outer layers 49 and 50 cooperate to form the heat resistant layer 48. However, the heat resistant layer 48 could be formed by only one of the inner and outer layers 49 and 50 if desired.

Having described the invention, the following is claimed:

1. A method of making a turbine engine component having a shroud ring with a plurality of airfoils disposed in an annular array, said method comprising the steps of providing a plurality of airfoils formed of a material having a first melting temperature, forming on at least one end portion of each of the airfoils a heat resistant layer which extends at least partially around the one end portion of each of the airfoils and has a second melting temperature which is greater than the first melting temperature, positioning the plurality of airfoils in an annular array, forming a mold having a shroud ring mold cavity in which the heat resistant layer on the one end portion of each of the airfoils is at least partially disposed, filling the shroud ring mold cavity with molten metal, engaging the heat resistant layer on the one end portion of each of the airfoils with the molten metal during performance of said step of filling the shroud ring mold cavity with molten metal, and solidifying the molten metal in the shroud ring mold cavity to form the shroud ring, said step of solidifying molten metal in the shroud ring mold cavity includes leaving joints between the one end portion of each of the airfoils and the solidified metal in the shroud ring mold cavity free of bonds to enable thermal expansion to occur between the airfoils and the shroud ring during use of the turbine engine component, wherein said step of forming a heat resistant layer includes forming a layer of chromium sesquioxide ($Cr_2O_3$) which extends at least partially around the one end portion of each of the airfoils .

2. A method as set forth in claim 1 wherein said step of forming a layer of chromium sesquioxide which extends at least partially around the one end portion of each of the airfoils includes heating the one end portion of each of the airfoils to a temperature above 1,093° C. in an atmosphere containing oxygen.

3. A method as set forth in claim 1 wherein said step of providing a plurality of airfoils includes providing a plurality of airfoils formed of a nickel-chrome superalloy.

4. A method as set forth in claim 1 wherein said step of engaging the heat resistant layer on the end portion of each of the airfoils with molten metal during performance of said step of filling the shroud ring mold cavity with molten metal includes engaging the heat resistant layer on the end portion of each of the airfoils with molten metal which is at a temperature above the first melting temperature.

5. A method as set forth in claim 1 wherein said step of providing a plurality of airfoils includes providing a plurality of airfoils formed of a metal alloy, said step of forming a heat resistant layer which extends at least partially around the one end portion of each of the airfoils includes depleting the metal alloy forming the airfoils of at least one of the elements of the metal alloy adjacent to the surface of the one end portion of each of the airfoils.

6. A method as set forth in claim 5 wherein said step of providing a plurality of airfoils formed of a metal alloy includes providing a plurality of airfoils formed of a nickel-chrome superalloy, said step of depleting the metal alloy forming the airfoils of at least one of the elements of the metal alloy adjacent to the surface of the one end portion of each of the airfoils includes depleting the nickel-chrome superalloy of chromium.

7. A method as set forth in claim 6 wherein said step of depleting the nickel-chrome superalloy of chromium includes forming chromium sesquioxide ($Cr_2O_3$) at the surface of the on end portion of each of the airfoils.

8. A method as set forth in claim 1 wherein said step of forming a heat resistant layer includes forming a green oxide outer layer which contains chromium and extends at least partially around the one end portion of each of the airfoils.

9. A method as set forth in claim 8 wherein said step of forming a green oxide outer layer includes heating at least one end portion of each of the airfoils to a temperature above 1,093° C. in an atmosphere containing oxygen.

10. A method as set forth in claim 1 wherein said step of forming a heat resistant layer includes the steps of forming an outer layer which has a first composition and forming an inner layer which has a second composition, said inner and outer layers cooperating to form the heat resistant layer and extending at least part way around the one end portion of each of the airfoils.

11. A method as set forth in claim 1 wherein said step of forming a heat resistant layer includes the steps of removing an element from an inner layer which extends at least part way around the one end portion of each of the airfoils and forming an outer layer of an oxide of the element removed from the inner layer around the outside of the inner layer.

12. A method as set forth in claim 1 wherein said step of providing a plurality of airfoils includes providing a plurality of airfoils formed of a nickel-chrome superalloy, said step of forming a heat resistant layer includes the steps of removing chromium from an inner layer of the nickel-chrome superalloy and forming an outer layer of an oxide of chromium around the inner layer.

13. A method as set forth in claim 12 wherein said step of forming an outer layer of an oxide of chromium around the inner layer includes forming a layer of chromium sesquioxide ($Cr_2O_3$) around the inner layer.

14. A method as set forth in claim 1 wherein said step of providing a plurality of airfoils formed of a material having a first melting temperature includes providing a plurality of airfoils formed of a material which melts at a temperature below 1,500° C., said step of forming a heat resistant layer having a second melting temperature includes forming a heat resistant layer having a melting temperature above 2,000° C.

* * * * *